US007980499B2

(12) United States Patent
Price

(10) Patent No.: US 7,980,499 B2
(45) Date of Patent: Jul. 19, 2011

(54) BLOCK DRESSING APPARATUS AND METHOD

(76) Inventor: Raymond R. Price, Rochester, MN (US)

( * ) Notice: Subject to any disclaimer, the term of this patent is extended or adjusted under 35 U.S.C. 154(b) by 0 days.

(21) Appl. No.: 12/169,433

(22) Filed: Jul. 8, 2008

(65) Prior Publication Data

US 2008/0276922 A1 Nov. 13, 2008

Related U.S. Application Data

(63) Continuation of application No. 10/477,878, filed as application No. PCT/US01/15894 on May 15, 2001, now abandoned.

(51) Int. Cl.
*B02C 13/00* (2006.01)

(52) U.S. Cl. ..... 241/188.1; 241/193; 241/283

(58) Field of Classification Search ..... 241/277, 241/193, 188.1, 283; 425/385
See application file for complete search history.

(56) References Cited

U.S. PATENT DOCUMENTS

| | | | | |
|---|---|---|---|---|
| 457,213 | A * | 8/1891 | Rittiger | 125/3 |
| 1,327,923 | A * | 1/1920 | Phillips | 125/13.01 |
| 1,454,731 | A | 5/1923 | Francis | |
| 2,248,839 | A | 7/1941 | Wandroik et al. | |
| 2,801,626 | A | 8/1957 | Potter et al. | |
| 3,067,731 | A | 12/1962 | Potter et al. | |
| 3,132,637 | A * | 5/1964 | Hinse | 125/4 |
| 3,575,155 | A * | 4/1971 | Byrd | 125/3 |
| 3,580,235 | A | 5/1971 | Lombos et al. | |
| 4,367,855 | A * | 1/1983 | von der Heide | 241/283 |
| 4,736,987 | A | 4/1988 | Lenzen et al. | |
| 5,485,366 | A * | 1/1996 | Iwata | 700/21 |
| 5,485,966 | A | 1/1996 | Cradeur | |
| 6,109,906 | A * | 8/2000 | Castonguay et al. | 425/343 |
| 6,540,501 | B1 * | 4/2003 | Bott | 425/385 |
| 7,063,284 | B2 * | 6/2006 | Modesti et al. | 241/197 |

* cited by examiner

*Primary Examiner* — Bena Miller
(74) *Attorney, Agent, or Firm* — Moore & Hansen, PLLP

(57) ABSTRACT

An apparatus and method for dressing marginal areas of externally viewable surfaces of a building block. The apparatus includes at least one chipper having rotational axis and a plurality of outwardly extending teeth randomly disposed thereabout. The chipper is positioned and oriented so that its teeth may effectively work a predetermined marginal area of interest. As the predetermined marginal area of interest and the teeth of the chipper are brought into contact with each other, portions of the marginal area are randomly impacted and fractured to form an erose or jagged surface that resembles hand dressing. The apparatus may also include additional chippers, each having a rotational axis and a plurality of teeth randomly disposed thereabout.

35 Claims, 5 Drawing Sheets

BLOCK DRESSING APPARATUS AND METHOD

RELATED APPLICATIONS

This is a continuation of application Ser. No. 10/477,878, filed Nov. 14, 2003 now adandoned, and published as U.S. publication number US 2004/0144378 A1 on Jul. 29, 2004, which is a national stage filing of PCT patent application No. PCT/US2001/015894, filed May 15, 2001, and published as WO 2002/092285 A2 on Nov. 21, 2002, all of which are hereby incorporated by reference.

BACKGROUND OF THE INVENTION

This invention relates generally to structures that may be built using masonry blocks. More particularly, this invention relates to an apparatus for and method of dressing externally viewable surfaces of masonry blocks used to construct mortarless retaining walls.

Retaining walls are widely used in a variety of landscaping applications. Typically, they are used to maximize or create level areas and also to reduce erosion and slumping. They may also be used in a purely decorative manner. In the past, retaining wall construction was labor intensive and often required the skills of trained tradespeople such as masons and carpenters. More recently, retaining wall construction has become significantly simplified with the introduction of self-aligning, modular molded blocks of concrete that may be stacked in vertical or offset courses without the use of mortar or any special skills. These blocks are available in a variety of shapes and sizes and a great many of them even allow a retaining wall to be curved or sinuous, so that it may be constructed circumjacent a tree, or parallel to a meandering pathway, for example.

Initially, these blocks were available in a limited number of sizes, shapes and textures. However, as the aforementioned blocks have become more and more popular, a greater variety of blocks of different styles have become available to the consumer. A particular style of block that is increasing in popularity is the rustic or weathered look. Rustic or weathered look blocks are desirable for several reasons. First, they convey the impression of craftsmanship that is nowadays frequently absent. Second, their time worn appearance conveys a sense of security and stability. And third, they are visually pleasing to an observer. With rustic or weathered blocks, it is possible to form structures that give the impression that they were constructed by artisans of a bygone era. These styles of blocks are particularly useful in restorative or rehabilitation work, or where certain stylistic and structural standards must be maintained.

A variety of approaches have been used to create rustic blocks. The most elementary and straightforward approach is to take a molded block and hand dress or roughen the surface. This approach has several drawbacks that are difficult to overcome. One, it significantly adds to the cost of the product because it is necessary to hire a person (or more likely, a crew of people) to perform this additional task. And, it may also be necessary to train or otherwise educate a person to perform such a task. Two, it increases the time necessary to produce such a product because hand dressing requires additional, time-consuming steps. Whether at the factory or at a job-site, each block must now be moved to a work station where it is hand dressed prior to use.

Since it is prohibitively expensive to hand dress block, alternative approaches to forming rustic blocks have been attempted. One approach has been to provide a patterned mold that is able to simulate a rustic surface. This approach has its drawbacks. One, It takes time and efforts to create and fabricate a mold. Two, the process of molding a block includes additional time consuming steps. Three, the process is limited to the formation of a particular style of block. And while it eliminates the step of hand dressing, a user is more-or-less stuck with the product as it comes from the mold. Any modification thereafter would defeat the purpose of such a block. And four, the molded surface does not have the appearance of hand dressing that is desired by the increasingly discerning and sophisticated customer.

Another approach is to take a molded block and place it in a rotatable container that tumbles it about (preferably, with other blocks or suitable material). This approach is much more cost effective and efficient that that of hand dressing each block. And, as with hand dressed blocks, each block so produced has a distinctive character. This approach, however, has a major drawback. The problem is that as a block is being tumbled, all of the exterior surfaces are being ground down. While this is a desirable result where the externally viewable surface of the block is concerned, it is an undesirable result for the remaining exterior surfaces of the block, particularly at the sides where the ability of adjacent blocks to be positioned flush against each other in a sealing relation may be compromised. Thus, instead of having linear side surfaces in sealing relation between adjacent blocks, there are now jagged side surfaces that form gaps or spaces therebetween. These gaps allow back-fill material to filter therethrough and accumulate in front of the structure. This is often exacerbated by rainfall that mixes with and transports particulate matter through the gaps, which may stain or otherwise leave residue on lower courses blocks that detracts from the overall appearance of the structure.

Another approach is to form them during the manufacturing process. This is most often accomplished by casting two blocks together in a single mold and splitting them apart along a predetermined plane. This creates two blocks, each with a front face that has the appearance of a natural split rock. A drawback with this approach is that blocks produced in this manner, while attractive, do not convey the impression that they were entirely hand worked. At best, they suggest that the blocks were broken away from a parent material and then machine dressed to predetermined dimensions. Thus, they have tight, thin, straight joints and, when assembled together, give the impression of a unitary structure having a textured surface.

Efforts to create a more realistic looking rustic block based on the aforementioned split-face block have taken several approaches. One approach is to hand dress selected portions of a block. This approach is less labor intensive than hand dressing the entire surface of a block as previously mentioned, but it still has the same aforementioned drawbacks—though to a lesser degree. One, it significantly adds to the cost of the product because it is necessary to hire a person (or more likely, a crew of people) to perform this additional task. And, it may also be necessary to train or otherwise educate a person to perform such a task. Two, it increases the time necessary to produce such a product because hand dressing requires additional, time-consuming steps. Whether at the factory or at a job-site, each block must now be moved to a work station where it is hand dressed prior to use.

Yet another approach uses flails to modify the externally viewable surfaces of blocks. Typically, the flails comprise short sections of chain one end of which is affixed about the perimeter of a rotatable element, the other end of which is attached to a steel head. In operation, the steel heads of the flails strike the entire front surface of a block as they are swung about by the rotatable element. While the flails produce acceptable results, there are several drawbacks. One, in order for the flails to operate at maximum efficiency, they must be swung about at a high rotational speed. This presents potentially dangerous condition, for if a flail were to break loose from the rotating element, they could easily injure people within the vicinity. Two, single or multiple links of a chain could break loose. This means that the flails must be inspected periodically to ensure that there are no cracks or damaged links that may lead to failure. The result is down time and loss of production. Three, as the flails strike a surface, they tend to crush or blast away the material away and form large amounts of dust. This presents health concerns such as ingestion, inhalation and sanitation. Moreover, such dust may create dangerous operating conditions by reducing visibility within the immediate vicinity or by settling upon equipment and obscuring essential components such as gauges or warning stickers. And, airborne dust also creates the potential for explosions initiated by sparks or electrical discharges. Four, flails are noisy, and people in the vicinity may be adversely affected by prolonged exposure to the noise associated with operation of such a device—even with the provision of ear protection.

There is a need for a masonry block that, when assembled together with other masonry blocks to form a structure, creates the impression that craftsmen using hand tools constructed the structure. There is also a need for a masonry block that may have marginal areas of its externally viewable surface dressed and still be able to be combined with other masonry blocks to form joints that effectively prevent passage of particulate matter therebetween.

There is also a need for an apparatus that is able to dress externally viewable surfaces of blocks without altering the remaining surfaces of the blocks, and do so in a manner that minimizes the formation of undue amounts of dust. There is yet another need for an apparatus that may be adjusted to accommodate masonry blocks having different dimensions, and which may be configured and arranged to dress only marginal areas of externally viewable surfaces of masonry blocks. There is yet another need for an apparatus that is able to dress a plurality of masonry blocks in an expedient and efficient manner.

And, there is a need for a method by which rustic masonry blocks may be fabricated.

SUMMARY OF THE INVENTION

The present invention comprises an apparatus for working externally viewable surfaces of masonry blocks in such a manner so that they appear to have been hand dressed. For purposes of this application, the term masonry block (or block) is intended to include any naturally occurring material, manmade material, molded cementitious block, natural and artificial stone or like material that may be used for buildings, indoor walls, partitions, facades, retaining walls, walkways, or other similar structures, with or without mortar. Preferably, the apparatus comprises a first station and a second station. The first station includes a pair of cylindrically shaped, rotatable chippers with each chipper having a rotational axis and a plurality of outwardly extending teeth randomly disposed thereabout. The chippers are adjustably arranged so that the rotational axes are parallel to and spaced apart from each other so that the outwardly extending teeth of the chippers do not interfere with each other during operation of the first station.

The first station also includes an adjustable block support that is positioned adjacent the chippers; preferably in an orthogonal relation relative to the rotational axes of the chippers. The support is configured and arranged to permit constrained movement of a block towards and away from the rotatable chippers to enable opposing, marginal areas of the externally viewable surface of a block to be simultaneously worked. In operation, the teeth of the chippers work or knap the opposing marginal areas of the externally viewable surface by percussively impacting and fracturing a block in a random manner. This produces an erose or jagged surface that is indicative of a rustic style block. For purposes of this application the term tooth (and its plural form, teeth) is intended to include any protrusion, projection, tooling or other such structure capable of dressing or knapping portions of a masonry block. Also for purposes of this application the term marginal area includes not only the areas adjacent the periphery of the externally viewable surface of a block but also other marginal areas form, for example, at the intersection formed by facets in a block having a non-planar externally viewable surface.

The second station includes another pair of cylindrically shaped, rotatable chippers with each chipper having a rotational axis and a plurality of outwardly extending teeth randomly disposed thereabout. As with the pair of chippers at the first station, the chippers in the second station are adjustably arranged so that the rotational axes are parallel to and spaced apart from each other so that the outwardly extending teeth of the chippers do not interfere with each other during operation.

The second station also includes an adjustable block support. As with the support at the first station, this support is positioned adjacent the chippers. However, instead of being positioned orthogonal to the rotational axes of the chippers as with the first station, this support is positioned so that it is collaterally aligned with and between the rotational axes of the chippers at the second station. The support is configured and arranged to permit constrained movement of a block collaterally with respect to the rotational axes of the rotatable chippers to enable opposing, marginal areas of the externally viewable surface of a block to be simultaneously worked. In operation, the teeth of the chippers work or knap the opposing marginal areas of the externally viewable surface by percussively impacting and fracturing a block in a random manner. This produces an erose or jagged surface that is indicative of a rustic style block. Thus, by using the first and second stations, it is possible to dress a plurality of marginal areas of an externally viewable surface of a masonry block in an efficient and expedient manner.

The apparatus may be used with a wide variety of preformed masonry blocks having a wide variety of sizes and surface textures. With the apparatus, it is possible to work a single or multiple areas of an exterior surface. For example, it is possible to work only the vertical margins of a block. Or, it is possible to work only the horizontal margins of a block. Or, it is even possible to work only one vertical margin and one horizontal margin. In that vein, it is envisioned that the apparatus may even work marginal areas that are not at the periphery of an externally viewable surface.

Preferably, the apparatus is used in conjunction with masonry blocks that have a split-face or roughened surface, so that the entire externally viewable surface of the dressed block appears rustic.

It is an object of the present invention to provide an apparatus that is able to dress marginal areas of a masonry block.

Another object of the present invention is to provide a method by which a masonry block may be dressed.

Yet another object of the invention is to form erose marginal areas that simulate hand dressing.

It is another object of the present invention to increase the speed at which rustic masonry blocks may be fabricated by providing a plurality of chipper units.

It is yet another object of the invention to provide a masonry block that, after dressing, is able to substantially contact an adjacent masonry block and effectively prevent particulate matter from passing therebetween.

A feature of the present invention is the use of chipper having a body with a rotational axis, about which a plurality of teeth are randomly disposed.

Another feature of the invention is that the components of the apparatus may be adjusted to provide different knapping depths, or to accommodate differently sized blocks.

An advantage of the present invention is that the randomly disposed teeth impact a marginal area being worked at a relatively slow speed.

Another advantage of the present invention is that formation of dust during the knapping process is minimized.

An advantage of the present invention is that the apparatus is able to accommodate a variety of differently shaped blocks.

Another advantage of the invention is that a plurality of dressed blocks may be dressed in an expedient and efficient manner.

These and other objectives, features and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

DETAILED DESCRIPTION

Figure 1:
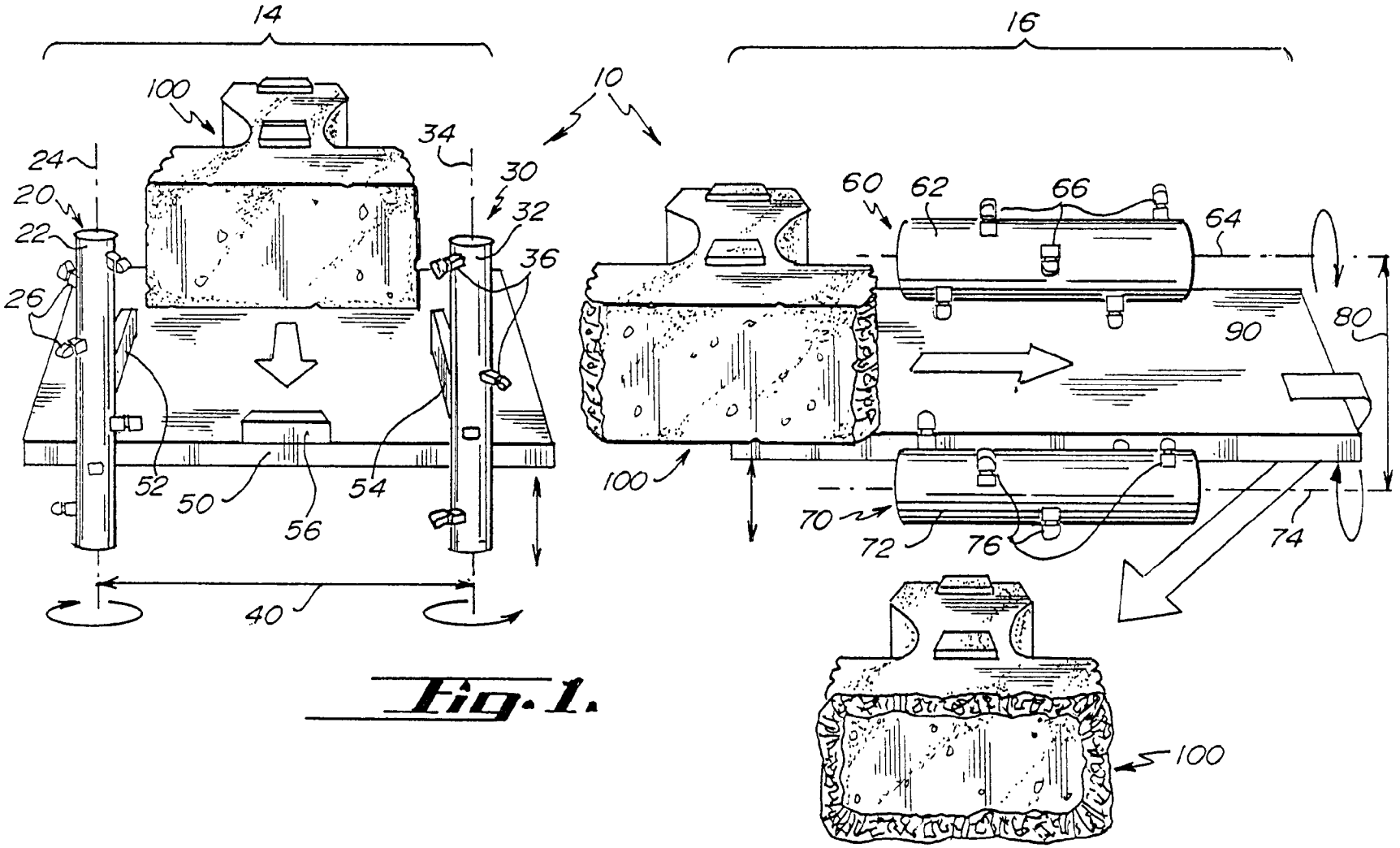
FIG. 1 is a schematic representation of an embodiment of the present invention illustrating a masonry block as it proceeds to different stations of a block dressing apparatus.

With reference to FIG. 1 a block dressing apparatus 10 and an associated block 100 are depicted schematically, with the block 100 progressing through first and second stations 14, 16 of the apparatus 10. Beginning at the first station 14, a block 100 that is to be dressed is positioned so that the externally viewable surface is in confronting relation to the chippers 20, 30 of the first station 14. The block 100 is then moved towards the chippers 20, 30 so that the teeth of the chippers knap or otherwise work marginal areas (in this depiction, the marginal areas are at opposing transverse peripheral surfaces). The block is then moved away from the chippers 20, 30. If other marginal areas are to be dressed, the block 100 is moved to the second station 16. There, the block 100 is moved in a collateral direction relative to a second set of chippers 60, 70 which also knap or otherwise work the other marginal areas (in this depiction, the marginal areas are along opposing longitudinal peripheral surfaces) and complete the dressing process.

Generally, the first station 14 comprises first and second chippers 20, 30 and a support 50. More specifically, the first chipper 20 includes a body 22 with a rotational axis 24 and a plurality of outwardly extending teeth 26 randomly disposed thereabout. The second chipper 30 includes a body 32 with a rotational axis 34 and a plurality of outwardly extending teeth 36 randomly disposed thereabout. The first and chipper bodies 22, 32 are cylindrically shaped and have a diameter of around 1.0-4.0 inches (2.54-10.00 cm), respectively, and a preferred diameter of around 2.0-3.0 inches (5.00-7.50 cm). The first and second chippers 20, 30 may be operatively connected to separate motive sources, or preferably a single motive source such as a hydraulic motor and a drive chain (not shown) that rotate the chippers 20, 30 at a rate of around 100-500 revolutions per minute (rpm) and preferably around 200-375 rpm. As will be appreciated, the rotational directions of the first and second chippers 20, 30 are chosen to so that the chippers work in opposition to each other.

A support 50 is positioned adjacent the first and second chippers 20, 30 in an orthogonal position relative to the rotational axes of the first and second chippers 20, 30. The support 50 is configured to allow a block to move in a constrained manner. This may be done with the provision of adjustable fences 52, 54 and an adjustable stop 56. The stop 56 may be provided with a biasing element 58 that assists in disengaging a block from contact with the chippers 20, 30. While this embodiment uses fences and a stop to direct the movement of a block with respect to the chippers 20, 30 other arrangements are possible. For example, the support 50 may be provided with a channel or aperture (not shown) that is configured to receive an indexing projection of a block (See, for example, the projections depicted in the blocks of FIGS. 8 and 10) thus eliminating the need for auxiliary fences 52, 54 and stop 56. Or, the support itself may be used to move a block into engagement with the chippers.

As with the first station, the second station 16 generally comprises a pair of third and fourth chippers 60, 70 and a support 90. More specifically, the third chipper 60 includes a body 62 with a rotational axis 64 and a plurality of outwardly extending teeth 66 randomly disposed thereabout. The fourth chipper 70 includes a body 72 with a rotational axis 74 and a plurality of outwardly extending teeth 76 randomly disposed thereabout. The third and fourth 62, 72 are also cylindrically shaped. They are larger in diameter than the first and second chippers, however, and have a diameter of around 4.0-6.0 inches (10.00-15.25 cm), respectively, and a preferred diameter of around 4.5-5.5 inches (11.40-14.00 cm). The third and fourth 60, 70 are also operatively to motive sources, or preferably connected to a motive source such as a hydraulic motor and a drive chain (not shown) that rotate the chippers 60, 70 at a rate of around 10-200 revolutions per minute (rpm) and preferably around 50-150 rpm. As will be appreciated, the rotational directions of the first and second chippers 60, 70 are chosen to so that the chippers work in opposition to each other so that the forces of impact tend to cancel each other out.

A support 90 is positioned adjacent the third and fourth chippers 60, 70 collaterally and between the rotational axes 64, 74 of third and fourth chippers 60, 70. The support 90 is configured to allow a block to move in a constrained manner. This may be done with the provision of an adjustable fence 92 (See, FIG. 3). While this embodiment uses a fence to limit the movement of a block with respect to the chippers 60, 70 other arrangements are possible. For example, the support 90 may be provided with a channel or aperture (not shown) that is configured to receive an indexing projection of a block thus eliminating the need for auxiliary fence 92.

Figure 2:
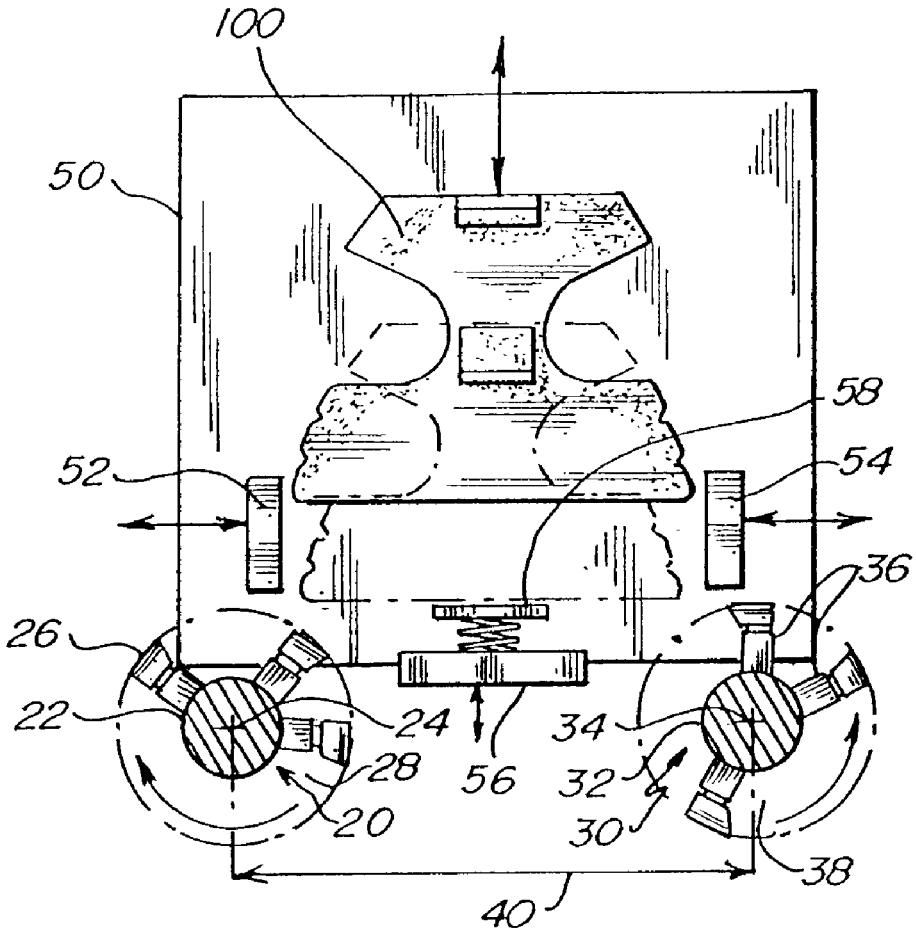
FIG. 2 is a schematic top plan representation of a first station of the apparatus of FIG. 1 wherein the first station is configured to dress a first set of opposing marginal areas of an externally viewable surface.
Figure 3:
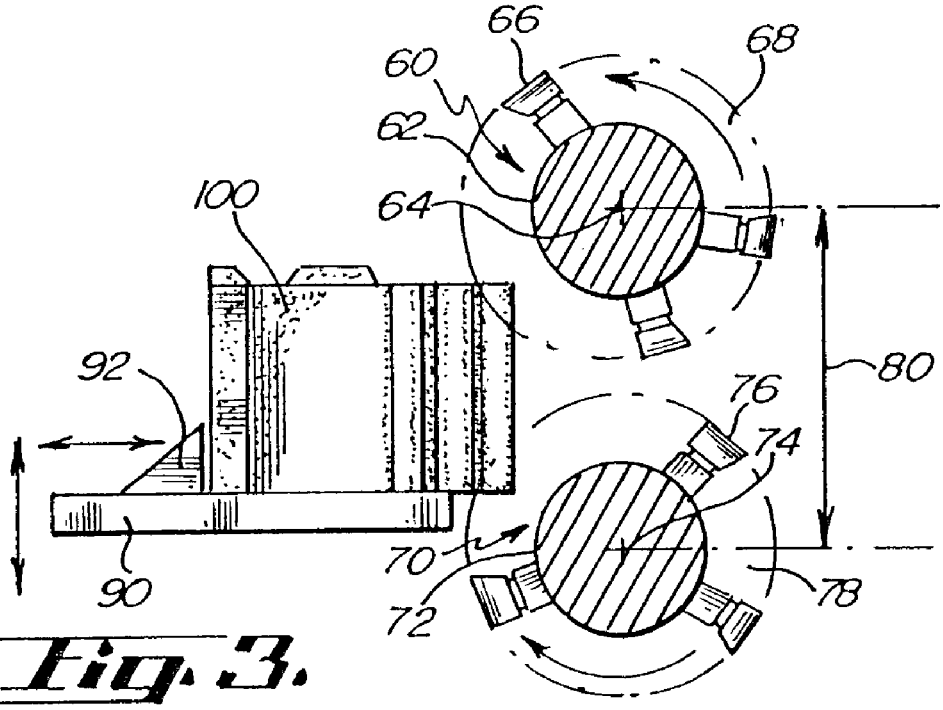
FIG. 3 is a schematic side plan representation of a second station of the apparatus of FIG. 1 wherein the second station is configured to dress a second set of opposing marginal areas of an externally viewable surface.

With reference to FIGS. 2 and 3, a block 100 to be worked is brought to the first station 14 and positioned on the support 50 so that it will fit between the fences 52, 54 and so that the externally viewable surface faces the chippers 20, 30. The block 100 is then advanced towards the chippers 20, 30 and stop 56, opposing marginal areas of the block 100 will be introduced into the working fields 28, 38 of the chipper teeth 26, 36, respectively, and be knapped or dressed. When the block 100 contacts the stop 56, dressing of the opposing marginal areas is essentially complete. The block 100 is then withdrawn from engagement with the chippers 20, 30 with the assistance of a biasing element 58. After the block is disengaged from the chippers 20, 30 of the first station 14, the block 100 is brought to the second station 16 where it is positioned on the support 90 so that it is offset with respect to the third and fourth chippers 60, 70 and collaterally aligned with the rotational axes 64, 74 thereof. The block 100 is then advanced in a direction parallel to the chippers 60, 70 so that a second set of opposing marginal areas of the block 100 will be introduced into the working fields 68, 78 of the chipper teeth 66, 76, respectively, and be knapped or dressed. As the block 100 moves past the chippers 60, 70 the fence 92 maintains the distance and orientation between the block 100 and the chippers 60, 70 and ensures that the correct amount of material will be knapped from the block.

As will be appreciated, the speed at which the block 100 is moved relative to the chippers 60, 70 is an additional variable that contributes to the distinctive surfaces that may be achieved with the apparatus. For example, if the block 100 is moved rapidly relative to the chippers, the chipper teeth will impact the block a fewer number of times than if the block 100 is moved slowly relative to the chippers.

Figure 5:
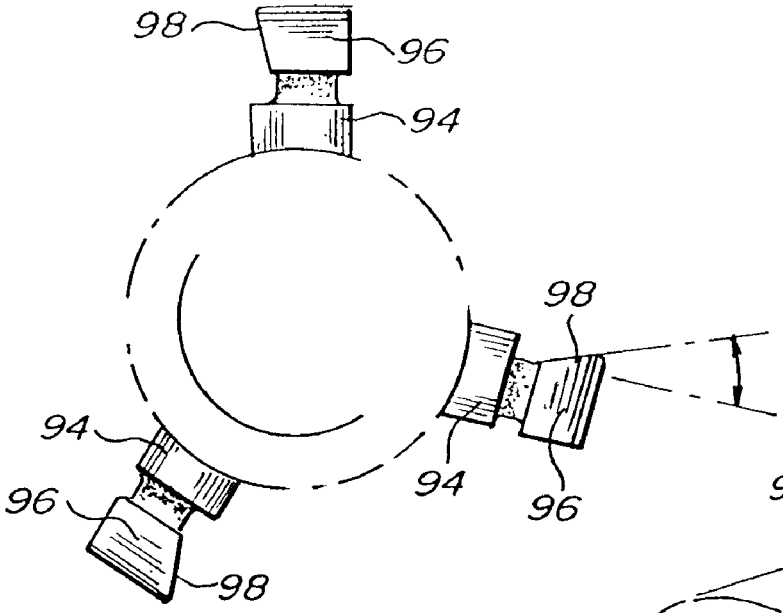
FIG. 5 is a side view of a chipper of the preferred embodiment illustrating one possible arrangement of a plurality of outwardly extending teeth about the rotational axis of the chipper (the chipper body shown in dashed lines)
Figure 4:
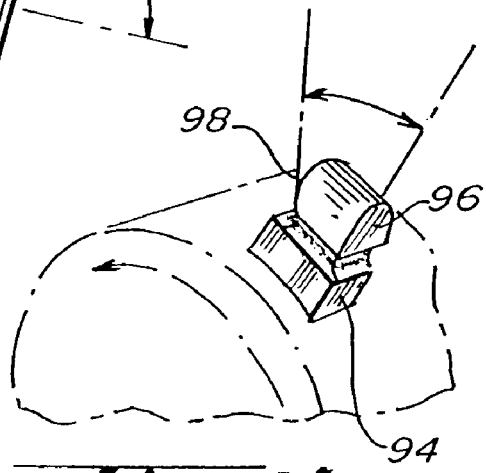
FIG. 4 is a perspective view of a chipping tooth that is attached to a body of a chipper (shown in dashed lines)

Referring to FIGS. 4 and 5, the teeth of the first, second third and fourth chippers 20, 30, 60, 70 are substantially the same. Generally, each tooth (26, 36, 66, 76 of chippers 20, 30, 60, 70, respectively) comprises a base 94 and a protrusion 96 that extends therefrom, with the protrusion including an impacting surface 98. As can be seen in FIG. 4, the tooth extends in a radial direction with respect to the rotational axis of the chipper, and is oriented so that the impacting surface 98 faces in the direction of rotation of the particular chipper to which it is attached. Turning to FIG. 5, the random arrangement of the outwardly extending teeth may be seen. Note that the teeth are randomly arranged with respect to the rotational axis and the length of each chipper (See, FIG. 1). Randomly arranged teeth are preferred because they are able to reproduce the erose or jagged surfaces indicative of hand dressing. And, when two or more chippers are used, this feature assures that the surfaces worked by different chippers will not appear the same, thus enhancing the rustic look. While it has been determined that commercially available replacement teeth for stump grinding machines work quite well with the chippers of the present invention, other teeth may be used. Preferably, each tooth is around 1.3-3.5 inches (4.0-10.0 cm.) in length, although it is understood that the teeth may have edifferent lengths and different impacting surface profiles, if desired. The teeth may be attached to the chipper body in a conventional manner, such as welding, or bolting. Or, alternatively, the teeth may be integral to the chippers.

In conjunction with the chippers, it is envisioned that the block dressing apparatus may be provided with static or movable brush-like elements (not shown) that finish a block by blending impact marks left by the teeth with the rest of the externally viewable surface. Alternatively, the chipper bodies themselves may include brush elements thereon (also not shown) so that they are able to dress and finish a portion of an externally viewable surface of a block.

Figure 6:
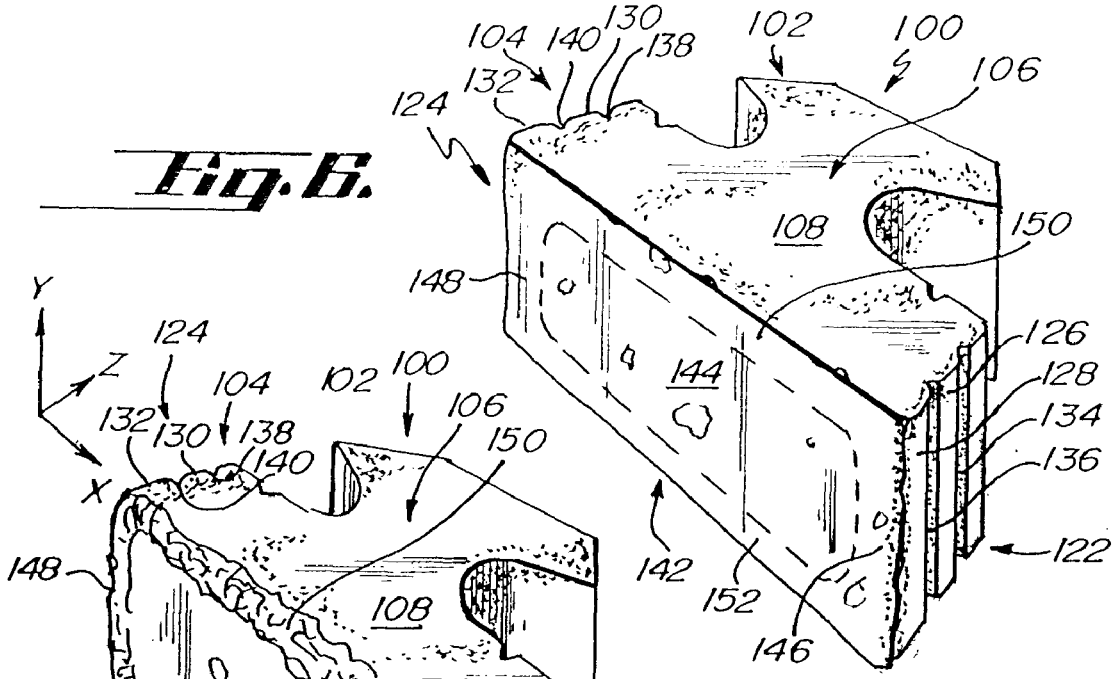
FIG. 6 is a perspective view of a preferred masonry block that has an externally viewable split-face surface and undressed marginal areas.
Figure 7:
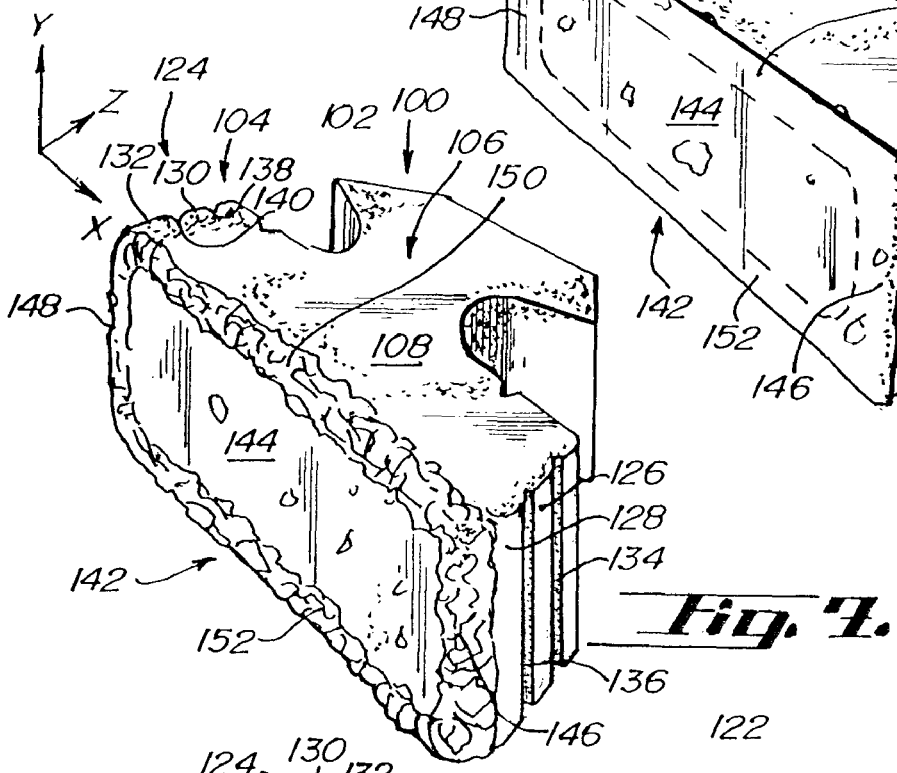
FIG. 7 is a perspective view of the masonry block of FIG. 6 with dressed marginal areas.
Figure 8:
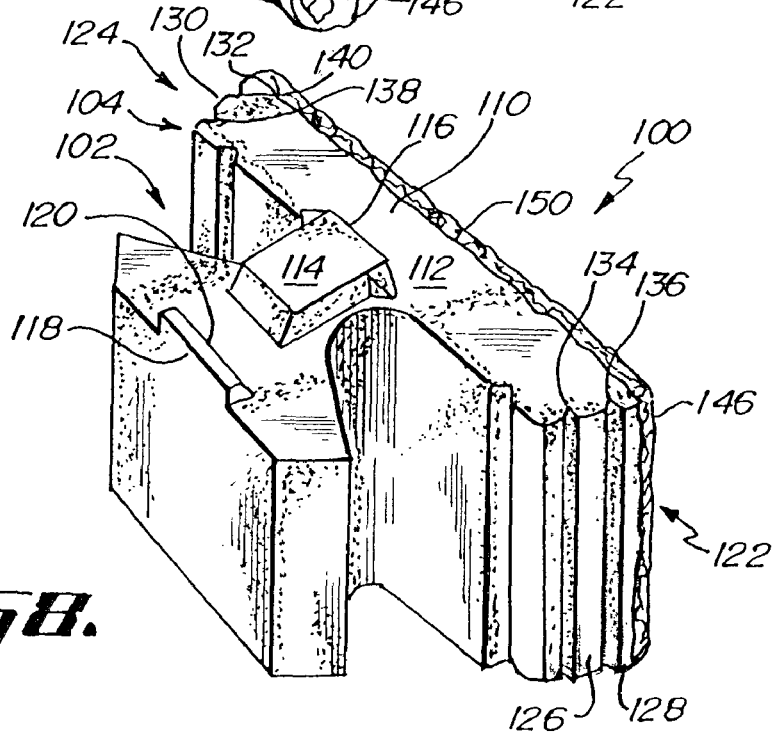
FIG. 8 is an inverted and reversed perspective view of the block of FIG. 7.

Referring now to FIGS. 6, 7 and 8, a typical, representative masonry block 100 that may be used in conjunction with the block dressing apparatus 10 is shown prior to, and after dressing its marginal areas. Generally, the block 100 has two parts, a rear extension 104 and a front member 104. Since the rear extension 102 does not involve the inventive concepts in this disclosure, it will not be discussed in great detail. In addition to the rear extension 102 and the front member 104, the block 100 includes a top 106 with a block contacting surface 108, a bottom 110 with a block contacting surface 112, and opposing sides 122, 124. Typically, the bottom 110 may include two projections 114, 118 with indexing surfaces 116, 120, respectively, that are used to align and position as they are set in courses.

Each side 122, 124 includes block contacting surfaces 126, 128, and 130, 132, respectively. And, each side 122, 124 also includes splitting or fracture relief notches 134, 136, and 138, 140, respectively. The block 100 also includes an externally viewable surface 142 having a central area 144 (generally indicated by a dashed line) with opposing marginal areas 146, 148 and 150, 152. It will be appreciated that the central area 144 will vary depending upon the particular configuration of the block and the extent to which the block is to be dressed. Referring to FIG. 6, the block 100, as depicted, has not been dressed by the apparatus 10. As can be seen, the externally viewable surface 142 includes marginal areas 146, 148, 150 and 152 that form well defined angles with adjacent block contacting surfaces 128, 132, 108, 112, respectively.

The block depicted in FIGS. 7 and 8, has had its marginal areas 146, 148, 150 and 152 dressed, and no longer has the well defined angles formed by the marginal surfaces and the block contacting surfaces. When the marginal areas of a block are dressed in the rustic style, the block contacting surfaces are reduced in size and the ability of adjacent blocks to form an effective seal could be compromised. That is, the chippers of the apparatus could remove too much material. This is prevented by the notches 136, 140 that separate block contacting surfaces 126, 128, and 130, 132, respectively. Normally, after the dressing operation, there is enough of the block contacting surfaces 128, 132 left to form an effective seal with block contacting surfaces of adjacent blocks. If the block is knapped too hard, and the block contacting surfaces 128, 132 are compromised, the block contacting surfaces 126, 130 are available to form effective seals with adjacent blocks. This is possible because the notches 136, 140 isolate the block contacting surfaces and prevent cracks from propagating thereby. Thus, the block has a plurality of block contacting surfaces that may form a plurality of effective seals with adjacent blocks.

Figure 9:
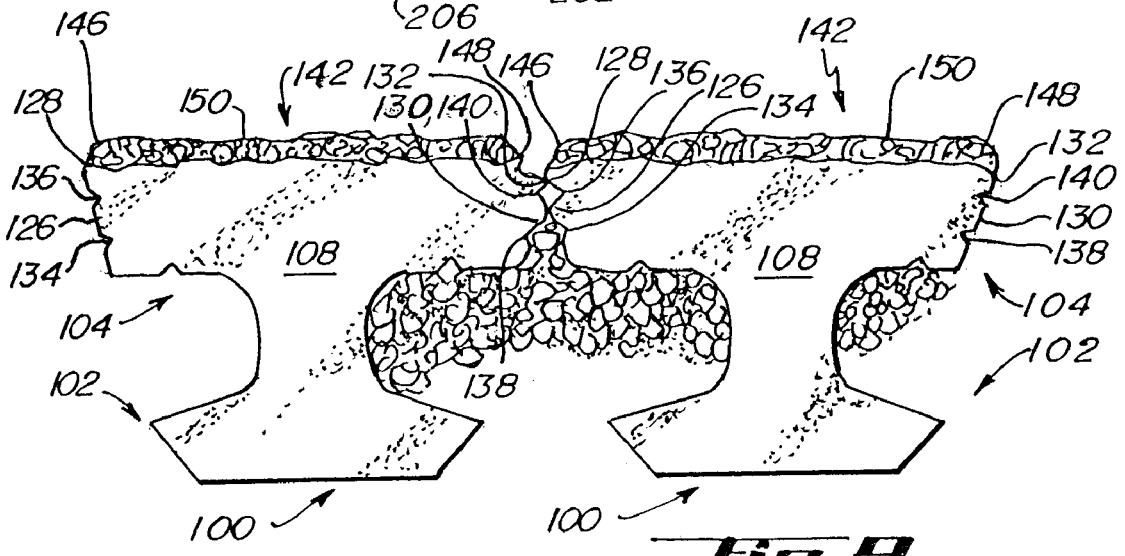
FIG. 9 is a top plan view of a plurality of blocks of FIG. 6 illustrating the effective seal formed by the block contacting side surfaces of adjacent blocks in a course of blocks.

Referring to FIG. 9, the importance of relief notches and block contacting surfaces 126, 128, 130 and 132 is illustrated. Here, fill material between adjacent blocks is prevented from passing therebetween by the effective seals formed by block contacting surfaces 126, 130, and 128, 132, respectively. It will be appreciated that an effective seal between adjacent blocks may be achieved even if the sealing ability between block contacting surfaces 128 and 132 is compromised due to excessive knapping or damage.

Figure 10:
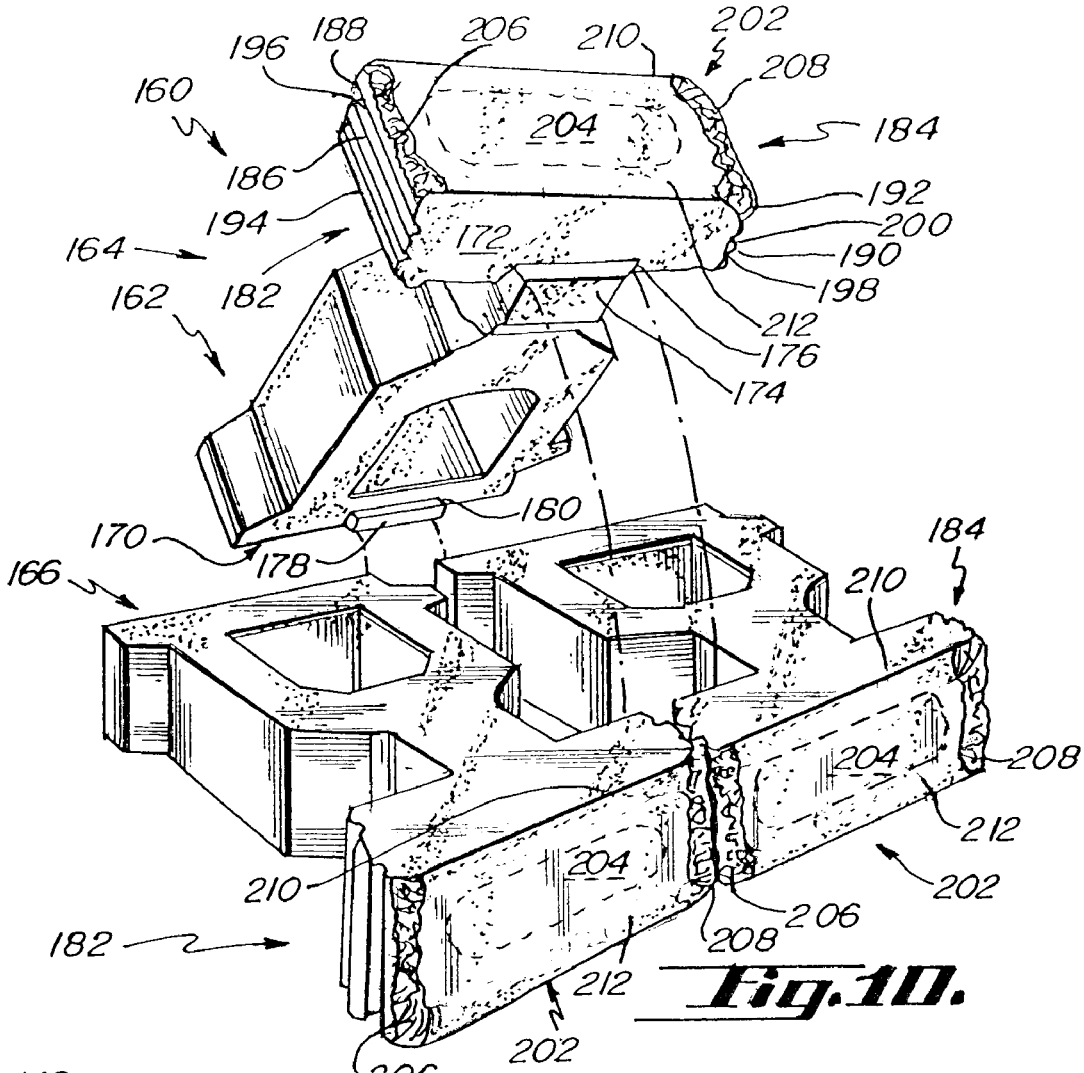
FIG. 10 is a perspective view of another preferred masonry block having a split-face externally viewable surface, and in which only the opposing vertical marginal areas have been dressed; and, FIG. 11 is a perspective view of a wall structure composed of differently sized blocks and which have differently dressed externally viewable surfaces.

Referring now to FIG. 10, another representative masonry block 160 that may be used in conjunction with the block dressing apparatus 10 is shown after dressing some of its marginal areas. As with the previously discussed block 100, this block 160 has two parts, a rear extension 162 and a front member 164. Since the rear extension 162 also does not involve the inventive concepts in this disclosure, it will not be discussed in great detail. In addition to the rear extension 162 and the front member 164, the block 160 includes a top 166 with a block contacting surface 168, a bottom 170 with a block contacting surface 172, and opposing sides 182, 184. Typically, the bottom 170 may include two projections 174, 178 with indexing surfaces 176, 180, respectively, that are used to align and position as they are set in courses.

Each side 182, 184 includes block contacting surfaces 186, 188, and 190, 192, respectively. And, each side 182, 184 also includes splitting or fracture relief notches 194, 196, and 198, 200, respectively. The block 160 includes an externally viewable surface 202 having a central area 204 (generally indicated by a dashed line) with opposing marginal areas 206, 208 and 210, 212. As with the aforementioned central area 144 of block 100, the central area 204 of this block 160 will vary depending upon the particular configuration of the block and the extent to which the block is to be dressed.

As depicted, the block(s) 160 have had their marginal areas 206, 208 dressed, and no longer have the well defined angles formed by the marginal surfaces and the block contacting surfaces. As with block 100, the block 160 has a plurality of effective seals formed by the block contacting surfaces of adjacent blocks. That is, an effective seal is formed by block contacting surfaces 186 and 190, and another effective seal is formed by block contacting surfaces 188, 192. The block 160 is also provided with relief notches 196, 200 that isolate the block contacting surfaces 186, 188, and 190, 192, respectively, and prevent undesirable crack propagation.

Figure 11:
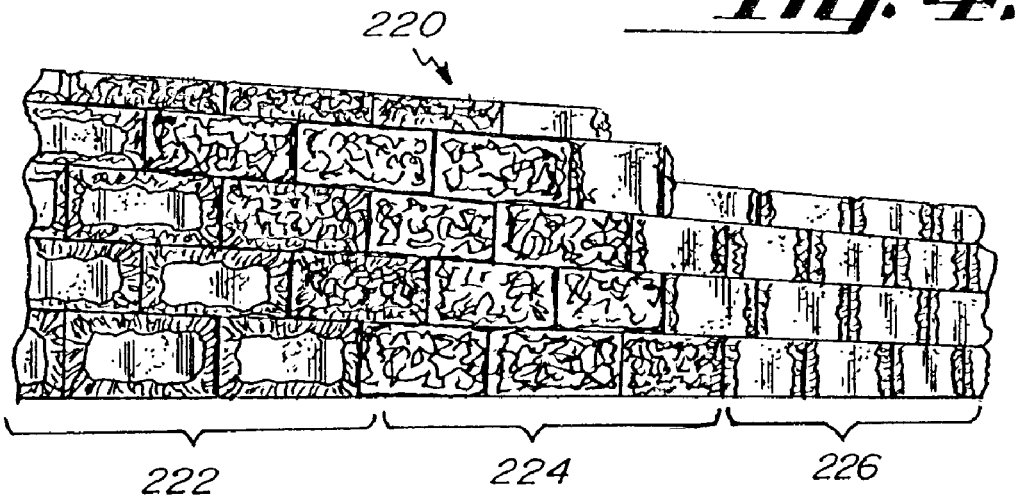

Referring to FIG. 11, a wall 220 is depicted with three diagonal columns of blocks. The leftmost diagonal column 222 comprises blocks that have a substantially smooth central area and dressed marginal areas, similar to the dressed block depicted in FIG. 7. The middle diagonal column 224 comprises blocks that have a roughened or textured surface and dressed marginal areas. And, the rightmost diagonal column 226 comprises blocks that have a substantially smooth central area and only the sides dressed, similar to the block depicted in FIG. 10. It is understood that the wall 220 is merely an example of the types of blocks and dressing that may be used in one type of construction, and that other blocks and dressing may be used in other structures.

A brief description of a preferred method of dressing a plurality of marginal areas of an externally viewable surface of a masonry block will now be discussed. Initially, a person would first start by determining the environment and structure in which the block is to be used—an outdoor retaining wall, for example. Then, an appropriately configured, preformed block would be selected and the areas to be worked determined. The components of the first and second stations of the apparatus would then be adjusted, if need be, to reflect the dimensional characteristics of the preformed block and the areas of the externally viewable surface to be worked. For example, it may be necessary to lengthen or shorten the distance between the rotational axes of parallel chippers at the first and second stations in order to bring the chippers into the desired confronting relation to marginal areas of an externally viewable surface to be worked. Similarly, it may also be necessary to adjust the guide fences, stop, and block supports.

Dressing a block using the apparatus of the present invention may now proceed. First, the block is moved to the first station and positioned so that the externally viewable surface confronts the first pair of chippers. The block is then moved in a constrained manner towards the chippers until it reaches a stop. As the externally viewable surface of the block approaches the stop, the marginal areas enter the working field of the teeth, which dress the surface. Dressing of these marginal areas is essentially complete at the point where the externally viewable surface of the block contacts the stop. After the block has reaches the stop, the now partially dressed block is withdrawn from engagement with the chippers of the first station and moved to the second station.

At the second station, the block is positioned parallel to and laterally offset with respect to the rotational axes of the second pair of chippers. The position of the block is then adjusted so that the marginal areas of the externally viewable surface that are to be worked will fall within the working fields described by the rotating teeth of the chippers. After making the necessary adjustments, the block is then moved parallel to the rotational axes of the second pair of chippers in a constrained manner. As the marginal areas of the externally viewable surface enter the working fields of the chipper teeth, they are dressed, and after the block passes the second pair of chippers, the marginal areas of the block are now completely dressed.

It will be appreciated that there are ways other than the preferred method of dressing a masonry block. For example, there could be separate stations where each marginal area could be dressed separately. Or there could be one station where all of the work is done. In that vein, it will also be appreciated that the block could be relatively stationary and the tooling is movable with respect thereto.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An apparatus for dressing a masonry block having an externally viewable, non-load-bearing surface with a central area, a first marginal area and a second marginal area, with the first and second marginal areas adjacent the central area, the apparatus comprising:

a support having a top, a front, a rear and a side edge, with the top configured to carry a masonry block positioned thereon; and a rotatable chipper, the chipper having a body with a rotational axis and a plurality of teeth rigidly attached to and extending radially outwardly from the body, with the chipper oriented so that the rotational axis of the body is generally parallel with the side edge of the support, with the plurality of teeth being unevenly spaced and randomly disposed about the body, and with the plurality of teeth configured and oriented to percussively engage and work only the first marginal area and not the central area of the externally viewable surface of the masonry block when the side edge of the support, with the masonry block positioned thereon, is moved from a position remote from the plurality of teeth to a position adjacent the plurality of teeth such that the plurality of teeth are able to randomly impact and fracture the first marginal area to form an erose surface in the first marginal area of the masonry block.

2. The apparatus of claim 1, wherein at least one of the plurality of teeth is attached directly to the body of the chipper.

3. The apparatus of claim 1, wherein the body is substantially cylindrical, has a diameter in the range of approximately 4.0 to apporoximately 6.0 inches and has a longitudinal axis, and wherein the rotational axis of the body is substantially coincident with said longitudinal axis.

4. The apparatus of claim 1, wherein each tooth of the plurality of teeth has a length of around 1.3-3.5 inches (4.0-10.0 cm.).

5. The apparatus of claim 1, wherein the chipper has a rotational speed of around 10-500 revolutions-per-minute.

6. The apparatus of claim 5, wherein the chipper has a rotational speed of around 50-375 revolutions-per-minute.

7. The apparatus of claim 1, further comprising:

a second rotatable chipper, the second chipper having a second body with a rotational axis and a plurality of teeth rigidly attached to and extending radially outwardly from the second body, with the plurality of teeth being unevenly spaced and randomly disposed about the second body, and with the plurality of teeth of the second body configured and oriented to percussively engage and work only the second marginal area and not the central area of the externally viewable, non-load-bearing surface of the masonry block;

wherein the rotational axis of the second chipper is generally parallel with the side edge of the support such that the plurality of teeth of the second chipper are able to randomly impact and fracture the second marginal area to form an erose surface in the second marginal area of the masonry block as the side edge of the support with the masonry block positioned thereon, is moved from a position remote from the teeth of the second chipper to a position adjacent the teeth of the second chipper.

8. The apparatus of claim 7, wherein at least one of the plurality of teeth of the second chipper is attached directly to the second body.

9. The apparatus of claim 7, wherein each tooth of the plurality of teeth of the second chipper has a length of around 1.3-3.5 inches (4.0-10.0 cm.).

10. The apparatus of claim 7, wherein the rotational axes of the first and second chipper bodies are substantially parallel to each other.

11. The apparatus of claim 7, wherein the first and second bodies are substantially the same size.

12. The apparatus of claim 7, wherein the second body is substantially cylindrical, has a diameter in the range of approximately 4.0 to approximately 6.0 inches and has a longitudinal axis, and wherein the rotational axis of the second body is substantially coincident with said longitudinal axis.

13. The apparatus of claim 7, wherein the first and second bodies are configured and arranged to simultaneously impact and fracture the first and second marginal areas and not the central area of the masonry block.

14. The apparatus of claim 7, wherein the first and second bodies are configured and arranged to rotate in opposite directions relative to each other.

15. The apparatus of claim 7, wherein the second chipper has a rotational speed of around 10-500 revolutions-per-minute.

16. The apparatus of claim 7, wherein the second chipper has a rotational speed of around 50-375 revolutions-per-minute.

17. The apparatus of claim 7, wherein the externally viewable, non-load-bearing surface of the masonry block further comprises a third marginal area adjacent the central area, and wherein the apparatus further comprises:

a second support having a top, a bottom and a side edge, with the top configured to carry a masonry block positioned thereon; and a third rotatable chipper, the third chipper having a third body with a rotational axis and a plurality of teeth rigidly attached to and extending radially outwardly from the third body, with the third chipper oriented so that the rotational axis of the third body is generally orthogonal to with the side edge of the second support, with the plurality of teeth being disposed about the third body, and with the plurality of teeth of the third body configured and oriented to percussively engage and work only the third marginal area and not the central area of the externally viewable surface of the masonry block;

wherein, the plurality of teeth of the third chipper are able to randomly impact and fracture the third marginal area to form an erose surface in the third marginal area of the masonry block as the side edge of the second support, with a masonry block positioned thereon, is moved from a position remote from the third chipper to a position adjacent the third chipper.

18. The apparatus of claim 17, wherein the externally viewable, non-load-bearing surface of the masonry block further comprises a fourth marginal area adjacent the central area, and wherein the apparatus further comprises:

a fourth chipper, the fourth chipper having a fourth body with a rotational axis and a plurality of teeth rigidly attached to and extending radially outwardly from the fourth body, with the fourth chipper oriented so that the rotational axis of the fourth body is generally orthogonal to with the side edge of the second support, with the plurality of teeth being disposed about the fourth body, and with the plurality of teeth of the fourth body configured and oriented to percussively engage and work only the fourth marginal area and not the central area of the externally viewable surface of the masonry block; wherein the plurality of teeth of the fourth chipper are able to randomly impact and fracture the fourth marginal area to form an erose surface in the fourth marginal area of the masonry block as the side edge of the second support, with a masonry block positioned thereon, is moved from a position remote from the fourth chipper to a position adjacent the fourth chipper.

19. The apparatus of claim 18 wherein the rotational axes of the third and fourth chippers are generally parallel to each other.

20. The apparatus of claim 18, wherein the rotational axes of the first and second chippers are generally orthogonally arranged relative to the rotational axes of the third and fourth chippers.

21. The apparatus of claim 18, wherein the plurality of teeth of the third chipper define a third working field, wherein the plurality of teeth of the fourth chipper define a fourth working field, and wherein the third and fourth working fields are horizontally spaced apart from each other.

22. The apparatus of claim 18, wherein the third and fourth bodies are configured and arranged to rotate in opposite directions relative to each other.

23. The apparatus of claim 18, wherein the third and fourth bodies are configured and arranged to simultaneously impact and fracture the third and fourth marginal areas and not the central area of the masonry block.

24. The apparatus of claim 7, wherein at least one of the plurality of teeth of the second chipper is attached directly to the body of the second chipper.

25. The apparatus of claim 7, wherein the second chipper is located adjacent to and laterally spaced from the side edge of the support.

26. The apparatus of claim 7, wherein the plurality of teeth of the first chipper define a first working field, wherein the plurality of teeth of the second chipper define a second working field, and wherein the first and second working fields are vertically spaced apart from each other.

27. The apparatus of claim 1, wherein a majority of the plurality of teeth are attached directly to the body of the chipper.

28. The apparatus of claim 1, wherein the chipper is located adjacent to and laterally spaced from the side edge of the support.

29. The apparatus of claim 1, wherein at least one of the teeth is integrally formed with the body of the chipper.

30. An apparatus for dressing an externally viewable, non-load-bearing surface of a masonry block, the apparatus comprising:

a support having a top surface, a front, a rear and a side edge, with the top surface configured to carry a masonry block positioned thereon;

a first rotatable chipper having a first body with a rotational axis and a plurality of teeth attached to the first body and extending radially outwardly therefrom, and with the first chipper oriented so that the rotational axis of the body is generally parallel with the side edge of the support; and a second rotatable chipper having a second body with a rotational axis and a plurality of teeth attached to the second body and extending radially outwardly therefrom, and with the second chipper oriented so that the second rotational axis of the second body is generally parallel with the side edge of the support;

wherein the first and second chippers are positioned so that they are able to percussively engage and work marginal portions of the externally viewable surface of the masonry block as the side edge of the support is positioned adjacent working fields of the first and second chippers and moved in a direction that is substantially parallel to the rotational axes of the first and second chippers.

31. The apparatus of claim 30, wherein each of the first and second bodies has an axial length, and wherein at least two teeth of one of the pluralities of teeth of the first or second chippers are axially offset from each other along the axial length of said first or second chipper body.

32. The apparatus of claim 30, wherein the pluralities of teeth of at least one of the first or second chippers are unevenly spaced and randomly disposed about said first or second chipper body.

33. The apparatus of claim 30 wherein at least one of the teeth of at least one of the first or second bodies is integrally formed with said first or second body.

34. The apparatus of claim 30, wherein at least one of the teeth of at least one of the first or second bodies is welded to said first or second body.

35. The apparatus of claim 30 wherein a substantial number of teeth of at least one of the first or second bodies are integrally formed with said first or second body.

* * * * *